US006574931B2

(12) United States Patent
Duany

(10) Patent No.: US 6,574,931 B2
(45) Date of Patent: Jun. 10, 2003

(54) RESIDENTIAL DWELLING SYSTEM AND BUILDING

(75) Inventor: Andres M. Duany, Coral Gables, FL (US)

(73) Assignee: Duany Plater-Zyberk & Company, Inc., Miami, FL (US)

( * ) Notice: Subject to any disclaimer, the term of this patent is extended or adjusted under 35 U.S.C. 154(b) by 0 days.

(21) Appl. No.: 09/767,703

(22) Filed: Jan. 24, 2001

(65) Prior Publication Data

US 2002/0095891 A1 Jul. 25, 2002

(51) Int. Cl.[7] ..... B65B 1/28

(52) U.S. Cl. ..... 52/234; 52/236.3; 52/169.2

(58) Field of Search ..... 52/234, 236.3, 52/169.2

(56) References Cited

PUBLICATIONS

The Steinberg Collaborative AIA Architects and Planners Floor Plan Job No. 97–058 Project built in 1993.*

* cited by examiner

*Primary Examiner*—Carl D. Friedman
*Assistant Examiner*—Nahid Amiri
(74) *Attorney, Agent, or Firm*—McGuireWoods LLP

(57) ABSTRACT

A multi-unit residential building design has a system of contiguous dwelling units arranged to occupy a single story at a high density. Each unit, whatever the number of bedrooms, is formed from an arrangement of overlapping rectangles, wherein most units assume a T-shape. These T-shaped units are positioned in either outer columns of the building or are embedded in inner columns; however, the layout of each unit is substantially the same. The building is constructed as an interlocking set of units which minimizes exterior wall space and maximizes density. The interlocking character of the design also allows all the rooms of each unit to have suitable window frontage, and provides for up-scale features such as courtyards for the embedded units.

26 Claims, 2 Drawing Sheets

RESIDENTIAL DWELLING SYSTEM AND BUILDING

BACKGROUND OF THE INVENTION

The invention is generally related to multi-tenant housing designs, and, more particularly, to a building type that accommodates multiple dwelling units at a high density in a single story.

As environmental issues and fear of sprawl have reduced the availability of land for development, density has become an important planning tool. Consequently, the ability to provide housing of high density in the more intrinsically affordable single-story configuration has become an acute need.

During the 1960's and 1970's, high density affordable housing was provided in high rise towers. Most of these projects have become social failures and are now being demolished. The failures have been traced to problems inherent in placing lower income residences in buildings accessed by elevators and corridors, which are unsafe and difficult to maintain; buildings in which the open space is unassigned to corresponding units; and buildings where the parking, where it exists, cannot be properly monitored from the building. An effort to find a replacement model continues today.

SUMMARY OF THE INVENTION

There is a need for housing that fulfills the following criteria: It must be of high density to be economical to land and infrastructure costs; it is preferable if it is single story, as this is much easier to build by an unskilled workforce; it should provide entrances to each unit directly from the street without the intermediary of semi-public elevators or corridors which are subjected to vandalism and require undue maintenance; its parking should be directly adjacent to the unit for purposes of supervision; and it should look, insofar as possible, like single family housing rather than high-rise as this building should be able to be inserted into previously developed housing areas. Accordingly, it is an object of the invention to provide a housing system that will satisfy these criteria.

It is yet another object of the invention to provide a housing system and layout that minimizes exterior perimeter walls. By minimizing the amount of wall space devoted to exterior surfaces, the building can be built with considerable economy.

According to the invention, the residential dwelling system and building includes a predetermined arrangement of units disposed in an interlocking relationship in depth, such that it increases density, minimizes perimeter walls, and allows individual entrances. The predetermined arrangement preferably includes two outer rows and two embedded rows of similar units. The building accommodates units that are interchangeable in outline and are preferably identical in their kitchen, bathroom and bedroom layouts. The majority of the units are generally defined by overlapping rectangles that form a T-shape which creates an interlocking capability. Expensive exterior walls are minimized over the number of units in the building, as the perimeter of the inner rows of units are largely embedded in the outer rows. Furthermore, the design provides windows to the exterior for every room, including those of the embedded units. Preferably, the site plan for each inventive building includes a perimeter road which surrounds each building, and allows for a ratio of two parking spaces per unit immediately enfronting each unit so as to allow supervision. The building plan may be repeated for multiple floors to allow for very high density housing; however, the invention has the advantage that generally adequate densities can be achieved with a one level configuration.

DESCRIPTION OF THE DRAWINGS

The invention can be better understood with reference to the drawing figures, in which.

DETAILED DESCRIPTION OF THE PREFERRED EMBODIMENT

The invention provides a dwelling system and building that allows for accommodating the residential living requirements of singles, couples and families at a high density, while providing the occupants with the look and feel of a single family home environment. Specifically, features such as court yards, parking spaces for each unit being positioned directly in front of the unit, and adequate windows for every room in every unit are provided. However, a density analysis of a typical ten-unit building reveals a gross area calculation, including one-half the enfronting street with the parking at two cars per unit yielding nineteen (19) units per acre. A net area calculation of the building footprint excluding parking results in thirty two (32) units per acre. To achieve the same density with conventional apartment building layouts, three stories would be required, and materials and space would be wasted in these conventional designs on lobbies and stairs.

Figure 1:
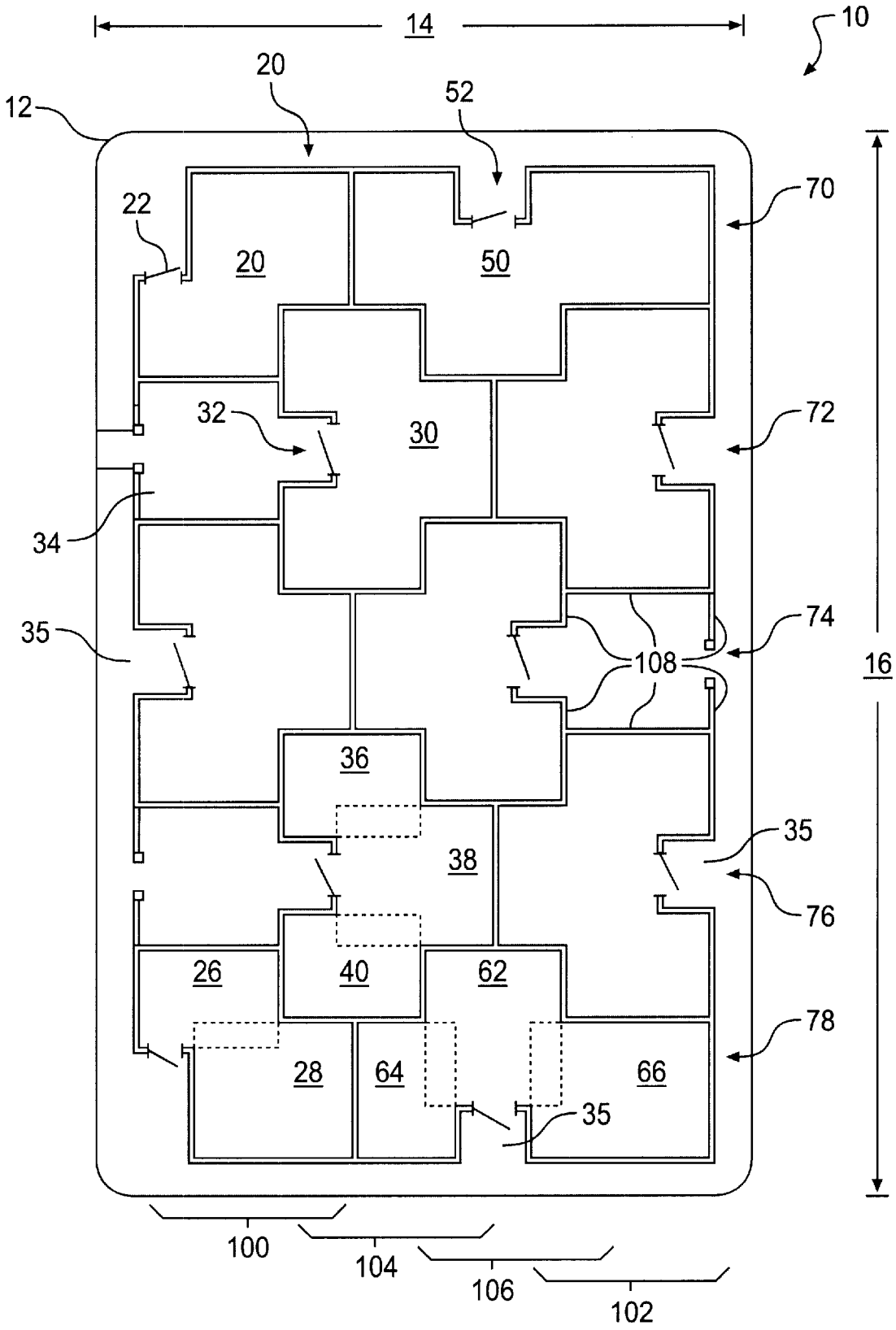
FIG. 1 is a general layout of the building showing the assemblage of dwelling units.
Figure 2:
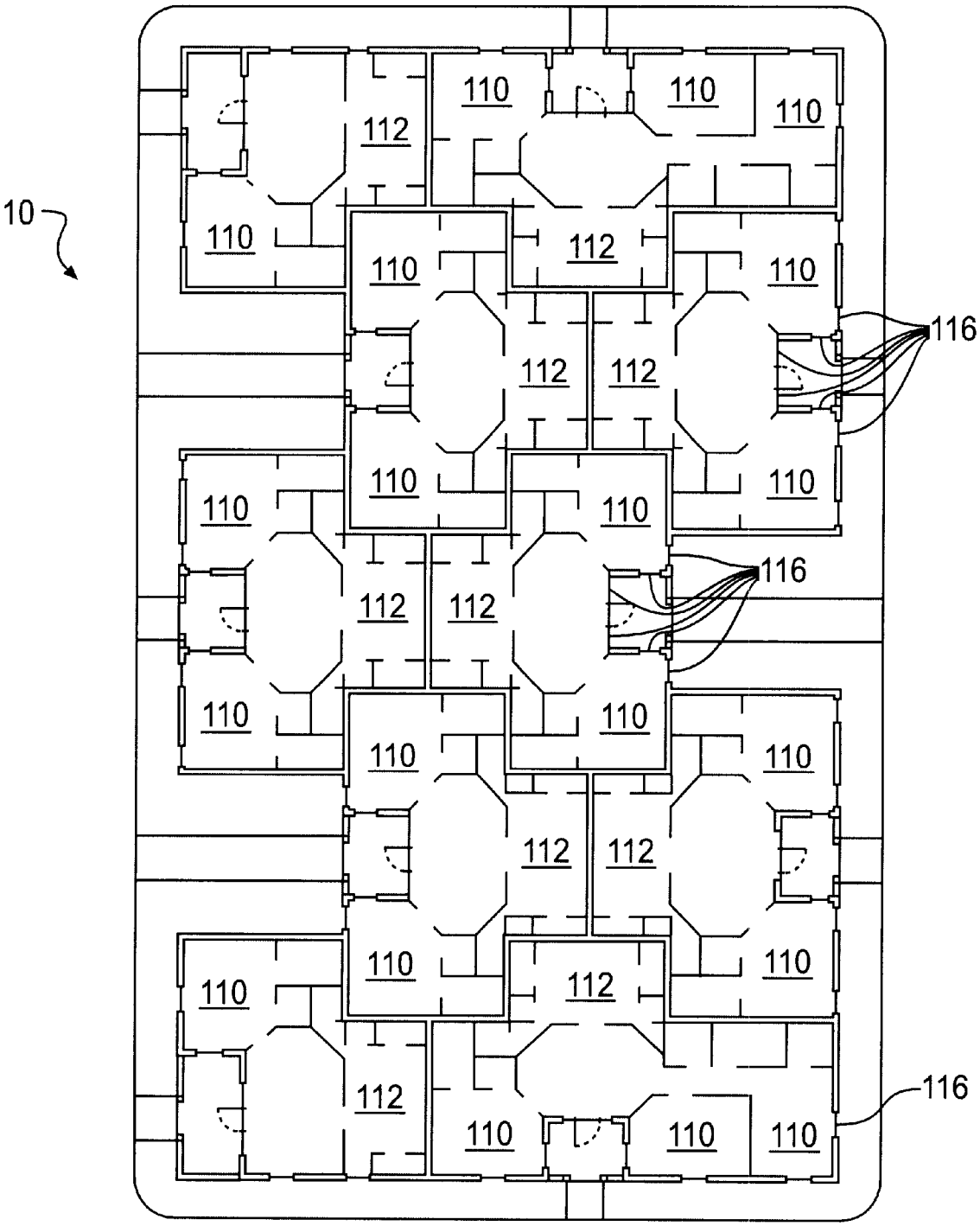
FIG. 2 is a plan view of the dwelling units in detail.

While FIGS. 1 and 2 show a building with two one-bedroom units, six two bedroom units, and two three bedroom units, it should be understood that the number of units can be varied simply by altering the length of the building. The interlocking nature of the embedded inner rows of units approaches the highest possible ratio of living space to land area in a single story multifamily dwelling. Further density can be achieved by repeating the layout in a multistory configuration. However, the single story arrangement provides for an inherent simplicity, and will allow these units to be built with any low technology conventional materials, such as lumber, adobe, hay bales, concrete block or metal. Furthermore, its modular quality lends itself to high tech pre-fabrication. Thus, the invention has broad national application.

FIG. 1 shows a floor plan 10 of a multi-compartment, multi-family building on a generally rectangular area 12. Preferably, the generally rectangular area includes a width 14 and a length 16 wherein the width is 80 feet and the length is 140 feet. A density analysis of a ten unit block reveals that under a gross calculation, 23,017 square feet are available in 1.89 acres providing 19 units per acre (gross). A net square footage results of 13,604 square feet and 3.20 acres for 32 units per acre (net). The floor plan shown in FIG. 1 provides two one-bedroom units, six two-bedroom units and two three-bedroom units for a total of ten units on the 80 feet by 140 feet rectangular area.

The building is arranged with a plurality of interlocking rows 70, 72, 74, 76, 78. Each row is formed with an interlocking arrangement of dwelling units. These include a one-bedroom type dwelling unit 20; a two-bedroom type dwelling unit 30; and a three-bedroom unit type dwelling unit 50. It should be understood that while the dwelling units, or apartments are configured for becoming one, two and three bedroom units, their use should not be considered restricted to this arrangement. The interlocking rows 70–78 form two columns 100 and 102 of outer units, and two columns 104 and 106 of inner or "embedded" units.

Each dwelling unit 20, 30, 50 is formed from at least two overlapping rectangles as seen in the plan by dashed lines. A one-bedroom, unit 20 is formed from a first rectangle 26 overlaying a corner portion of a second rectangle 28. A two-bedroom unit 30 is formed from 3 rectangles. A large, central rectangle 38 is overlaid on each corner by second and third rectangles 36, 40. The three-bedroom type units are formed from three rectangles, including a central rectangular 62 overlaid by two rectangles including a smaller rectangles including a smaller rectangle 64 and a larger rectangle 66. This arrangement maximizes the useable space available within the generally rectangular area 12.

Courtyards 34 are provided for the embedded units in columns 104 and 106. Smaller patio style entrances 35 can be provided for exterior units in columns 100 and 102 (although these entrances 35 can be internalized as foyer's for the units. The courtyards 34 and patio style entrances 35 give the buildings a single family style look and allocate outdoor living space to specific units.

Each unit has a portal 22, 32, or 52 (door and exit pathway) to one of the four sides of the building 10. A particular advantage of the present invention is that the exterior walls 108 are dramatically minimized compared to conventional units, with the interior or embedded units in columns 104 and 106 being restricted only to the front entrance, and the external units in rows 72, 74, and 76 realizing the advantages of many common surface walls with adjacent units. This can dramatically reduce construction costs since exterior wall treatments are reduced or eliminated.

FIG. 2 shows a more detailed view of the units in the building 10. Each of the units includes one or more bedrooms 110 and a kitchen/laundry area 112 which extend to a centrally located, generally octagonal living area 114. With reference to the right side of FIG. 2, it can be seen that there are windows 116 fronting every room in every unit, including the embedded units.

This arrangement of dwelling units provides substantial livability in a relatively small space and also provides an enhanced arrangement of dwelling units. It should be noted that this "jigsaw puzzle" type interlocking construction can be provided in a stacked, vertical arrangement to form a multi-story building having such dwelling units. It will be appreciated by those skilled in the art that the entrance ways to such multi-story dwelling units will be provided by stairways or elevators as necessary.

The invention can be practiced with considerable variation within the scope of the claims.

I claim:

1. A multi-compartment, multi-family dwelling building having a predetermined floorplan arrangement, said building comprising a plurality of multi-room dwelling units arranged to occupy a generally rectangular area and including a predetermined number of units disposed in a predetermined arrangement of adjacent multiple rows and disposed in an overlapping and interlocking relationship to provide a substantially maximized ratio of dwelling units throughout the useable space available in said generally rectangular area, wherein each dwelling unit includes a portal to one of four sides of said generally rectangular area.

2. A multi-compartment, multi-family dwelling building according to claim 1 wherein said predetermined arrangement of adjacent multiple rows includes a first row type including a predetermined number of one-bedroom sized units and a predetermined number of three-bedroom sized units, and a second row type including a predetermined number of two-bedroom sized units.

3. A multi-compartment, multi-family dwelling building according to claim 2 wherein said predetermined arrangement of adjacent multiple rows includes a plurality of said first row type rows and a plurality of said second row type rows.

4. A multi-compartment, multi-family dwelling building according to claim 3 wherein said predetermined arrangement of adjacent multiple rows includes two outer rows formed as said first row type and a plurality of inner rows formed as said second row type.

5. A multi-compartment, multi-family dwelling building according to claim 3 wherein said predetermined arrangement of adjacent multiple rows includes two outer rows formed as said first row type and three inner rows formed as said second row type.

6. A multi-compartment, multi-family dwelling building according to claim 1 wherein each said dwelling unit is formed from a plan of three overlapping polygons.

7. A multi-compartment, multi-family dwelling building according to claim 6 wherein said polygons are in juxtaposition across said rows.

8. A multi-compartment, multi-family dwelling building according to claim 1 wherein said generally rectangular area is one city block.

9. A multi-compartment, multi-family dwelling building having a predetermined floorplan arrangement, said building comprising a plurality of multi-room dwelling units arranged to occupy a generally rectangular area and including a predetermined number of one-bedroom units, a predetermined number of two-bedroom units, and a predetermined number of three-bedroom units, disposed in a predetermined arrangement of rows and disposed in an interlocking relationship to provide a substantially maximized ratio of dwelling units to useable space available in said generally rectangular area, wherein each dwelling unit includes a portal to one of four sides of said generally rectangular area, wherein at least one of said portals is disposed inwardly from a boundary line formed around said generally rectangular area.

10. A multi-compartment, multi-family dwelling building according to claim 1 wherein said building comprising a plurality of floors with each floor of said building being formed from said multi-room dwelling units.

11. A multi-compartment, multi-family dwelling building having a predetermined floorplan arrangement, said building comprising a plurality of multi-room dwelling units, said dwelling units being formed from a plan of three overlapping polygons, with said dwelling units being arranged to occupy a generally rectangular area and including a predetermined number of one-bedroom sized units, a predetermined number of two-bedroom sized units, and a predetermined number of three-bedroom sized units, disposed in a predetermined arrangement of rows and disposed in an interlocking relationship to provide a substantially maximized ratio of dwelling units to useable space available in said generally rectangular area, wherein each dwelling unit include a portal to one of four sides of said generally rectangular area and wherein said predetermined arrangement of rows includes a first row type including a predetermined number of one-bedroom sized units and a predetermined number of three-bedroom sized units, and a second row type including a predetermined number of two-bedroom sized units and wherein said predetermined arrangement of rows includes two outer rows formed as said first row type and a plurality of inner rows formed as said second row type.

12. A multi-compartment, multi-family dwelling building having a predetermined floorplan arrangement, said building comprising a plurality of floors with each floor of said building being formed of multi-room dwelling units, said dwelling units being formed from a plan of three overlapping polygons, with said dwelling units being arranged to occupy a generally rectangular area and including a predetermined number of one-bedroom sized units, a predetermined number of two-bedroom sized units, and a predetermined number of three-bedroom sized units, disposed in a predetermined arrangement of rows and disposed in an interlocking relationship to provide a substantially maximized ratio of dwelling units to useable space available in said generally rectangular area, wherein each dwelling unit include a portal to one of four sides of said generally rectangular area and wherein said predetermined arrangement of rows includes a first row type including a predetermined number of one-bedroom sized units and a predetermined number of three-bedroom sized units, and a second row type including a predetermined number of two-bedroom sized units and wherein said predetermined arrangement of rows includes two outer rows formed as said first row type and a plurality of inner rows formed as said second row type.

13. A system of contiguous residential dwelling units arranged to occupy a generally rectangular area, said system comprising a plurality of first type dwelling units, second type dwelling units and third type dwelling units, each dwelling unit being formed with a predetermined plan and defined by a plurality of overlapping rectangles, wherein said plurality of first type dwelling units, second type dwelling units and third type dwelling units are arranged in interlocking rows to provide an enhanced ratio of dwelling units to useable space available in said generally rectangular area, wherein each dwelling unit includes a portal to one of four sides of said generally rectangular area.

14. A system of contiguous residential dwelling units according to claim 13 wherein said interlocking rows include a first row type formed from a predetermined number of one-bedroom sized units and a predetermined number of three-bedroom sized units, and a second row type formed from a predetermined number of two-bedroom sized units.

15. A system of contiguous residential dwelling units according to claim 14 wherein said interlocking rows are formed in a predetermined arrangement of rows including a plurality of said first row type rows and a plurality of said second row type rows.

16. A system of contiguous residential dwelling units according to claim 15 wherein said interlocking rows are formed in a predetermined arrangement of rows including two outer rows formed as said first row type and a plurality of inner rows formed as said second row type.

17. A system of contiguous residential dwelling units according to claim 16 wherein said predetermined arrangement of interlocking rows includes three inner rows formed from said second row type disposed intermediate said outer rows.

18. A system of contiguous residential dwelling units according to claim 13 wherein said generally rectangular area is a size of one city block.

19. A system of contiguous residential dwelling units according to claim 13 wherein at least one of said portals is disposed inwardly from a boundary line formed around said generally rectangular area.

20. A system of contiguous residential dwelling units according to claim 13 wherein said system is repeated in a vertically stacked arrangement to produce a multi-story building.

21. A system of contiguous residential dwelling units arranged to occupy a generally rectangular area, said system comprising a plurality of first type dwelling units, second type dwelling units and third type dwelling units, each dwelling unit being formed with a predetermined plan and defined by a plurality of overlapping rectangles, wherein said plurality of first type dwelling units, second type dwelling units and third type dwelling units are arranged in interlocking rows to provide a substantially maximized ratio of dwelling units to useable space available in said generally rectangular area, wherein each dwelling unit include a portal to one of four sides of said generally rectangular area and said interlocking rows are formed in a predetermined arrangement of interlocking rows and said interlocking rows include two outer rows formed from a first row type characterized by a predetermined number of one-bedroom sized units and a predetermined number of three-bedroom sized units, and a plurality of inner rows formed from a second row type characterized by a predetermined number of two-bedroom sized units.

22. A system of contiguous residential dwelling units according to claim 21 wherein said predetermined arrangement of rows includes three inner rows formed from said second row type disposed intermediate said outer rows.

23. A system of contiguous residential dwelling units according to claim 21 wherein said generally rectangular area is a size of one city block.

24. A system of contiguous residential dwelling units according to claim 21 wherein at least one of said portals is disposed inwardly from a boundary line formed around said generally rectangular area.

25. A system of contiguous residential dwelling units according to claim 21 wherein said system is repeated in a vertically stacked arrangement to produce a multistory building.

26. A building, comprising multiple, interlocking rows of exterior and interior units with two columns of exterior units and two columns of interior units, wherein each unit has a common wall with at least two other units, and each unit has windows for each bedroom in each unit and for a centrally located living area, and wherein courtyards afront each interior unit and separate exterior units in said two columns of exterior units.

* * * * *